US007475939B1

(12) United States Patent
Hooker

(10) Patent No.: US 7,475,939 B1
(45) Date of Patent: Jan. 13, 2009

(54) PORTABLE COLLAPSIBLE OPEN AIR HANDS FREE SEATING SHELTER

(76) Inventor: Jimmy Hooker, 5121 Saddleridge Ct., Garland, TX (US) 75043

( * ) Notice: Subject to any disclaimer, the term of this patent is extended or adjusted under 35 U.S.C. 154(b) by 525 days.

(21) Appl. No.: 11/108,206

(22) Filed: Apr. 15, 2005

Related U.S. Application Data

(60) Provisional application No. 60/563,230, filed on Apr. 19, 2004.

(51) Int. Cl.
*A47C 7/66* (2006.01)

(52) U.S. Cl. ..... 297/184.11; 297/184.1; 297/184.15; 297/440.1; 297/440.14; 135/96

(58) Field of Classification Search ..... 297/184.1, 297/184.11, 184.15, 440.1, 440.14, 440.22; 135/98, 96
See application file for complete search history.

(56) References Cited

U.S. PATENT DOCUMENTS 206,670 A * 8/1878 Griffin ..... 297/184.11 X
1,271,515 A * 7/1918 Murray ..... 297/184.11 X
1,480,286 A * 1/1924 Morganstern ..... 297/184.11 X
2,014,614 A * 9/1935 Czygan ..... 297/184.15
3,052,251 A 9/1962 De Jean, Jr.
3,224,806 A * 12/1965 Butters et al. ..... 135/96 X
3,339,566 A * 9/1967 Bowden ..... 297/184.11
3,893,466 A 7/1975 Barker
4,035,606 A 7/1977 Browder
4,086,931 A * 5/1978 Hall ..... 135/98
4,100,633 A * 7/1978 Pintos ..... 297/184.11 X
4,687,249 A * 8/1987 Mills ..... 297/184.15
4,865,381 A * 9/1989 Van Rogue ..... 297/184.15
4,924,896 A * 5/1990 Carter ..... 297/184.15 X
5,000,210 A * 3/1991 Worthington, Jr. .. 297/184.15 X
5,013,085 A * 5/1991 Craig ..... 297/184.15
5,022,420 A * 6/1991 Brim ..... 297/184.1 X
5,096,257 A * 3/1992 Clark ..... 297/184.15
5,154,473 A * 10/1992 Joranco ..... 297/184.15
5,168,889 A * 12/1992 Diestel ..... 297/184.15 X
5,203,363 A * 4/1993 Kidwell et al. ..... 297/184.15 X
5,240,020 A * 8/1993 Byers ..... 297/184.15 X
5,287,872 A 2/1994 Anderson
5,301,975 A * 4/1994 Rivera ..... 297/184.15 X
5,441,067 A * 8/1995 James et al. ..... 297/184.15 X
5,560,383 A * 10/1996 Fuller ..... 297/184.15 X
5,582,458 A * 12/1996 Wildt ..... 297/184.15
5,624,152 A * 4/1997 Yoshie et al. ..... 297/184.13

(Continued)

*Primary Examiner*—Rodney B. White

(57) ABSTRACT

A portable collapsible open air hands free seating shelter having a base. A plurality of cover mounts detachablely coupled to the base. A cover slidably attached to the plurality of cover mounts.

A portable collapsible open air hands free seating shelter having a base with a plurality of raised top portions, a lower top portion substantially parallel to the plurality of raised top portions, a bottom portion and a outer side portion. A plurality of cover mounts having a continually intergraded vertical first end detachablely coupled to at least one of the plurality of raised top portions of the base and a horizontal second end such that the vertical first end and the horizontal second end are substantial perpendicular to each other. A cover having a continually intergraded canopy portion having a closed end, a head panel and a back support panel having an open end slidably attached to the horizontal second end of the plurality of cover mounts. A seat portion detachablely coupled to the lower top portion of the base. A plurality of seat clamps detachably coupled to the bottom portion of said base.

17 Claims, 7 Drawing Sheets

U.S. PATENT DOCUMENTS 5,797,650 A * 8/1998 Gonzalez et al. ..... 297/184.1
5,967,601 A * 10/1999 Gillins ..... 297/184.15
6,135,562 A * 10/2000 Infanti ..... 297/440.22 X
6,244,286 B1 * 6/2001 Russo ..... 297/184.11 X
6,353,933 B1 3/2002 Love
6,447,067 B1 * 9/2002 Williams et al. .... 297/184.11 X
6,478,037 B2 11/2002 Tung
6,789,557 B1 * 9/2004 Wahl, Jr. ..... 297/184.11 X
2002/0112752 A1 8/2002 Blakney

* cited by examiner

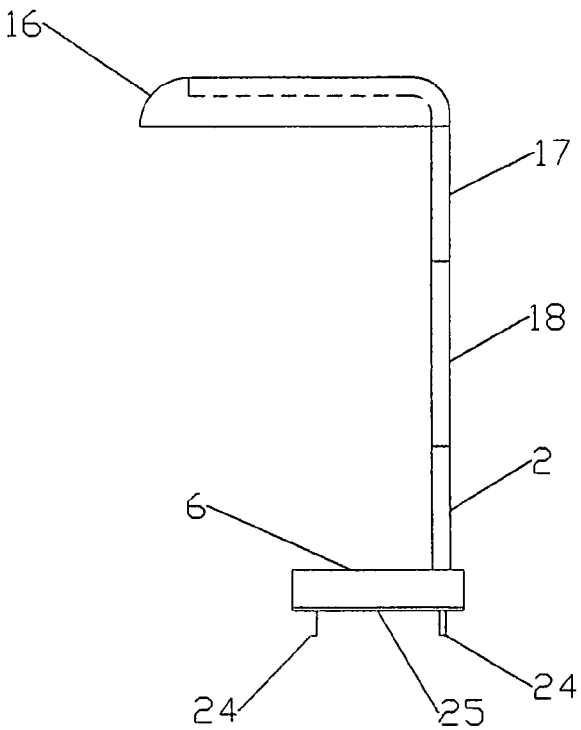
FIG. 2-B
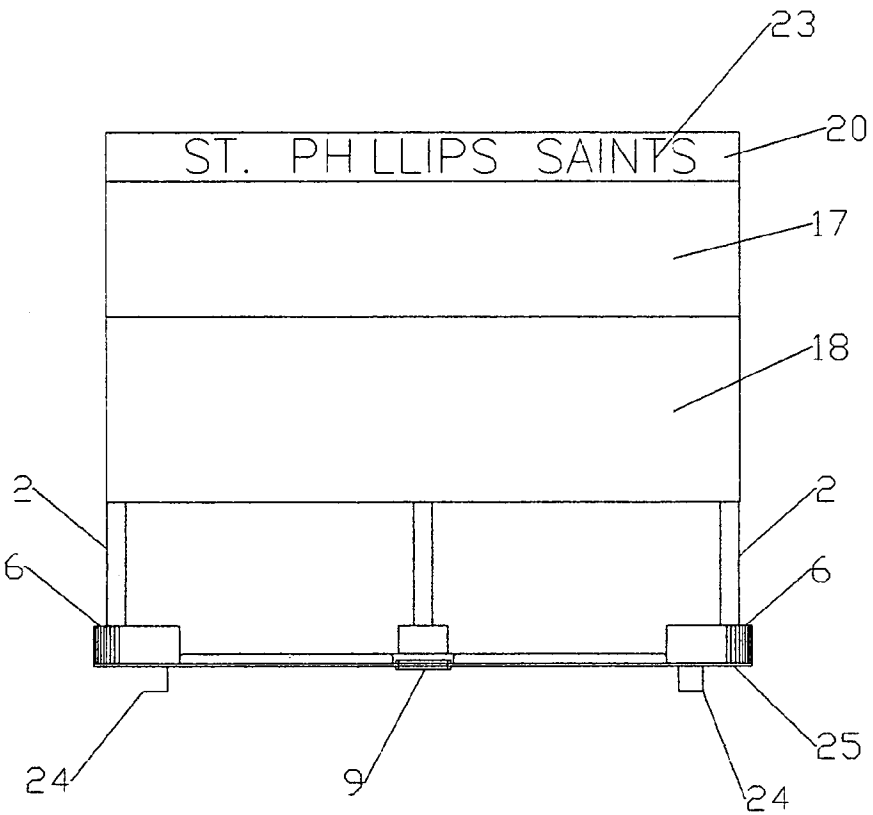
FIG. 2-A

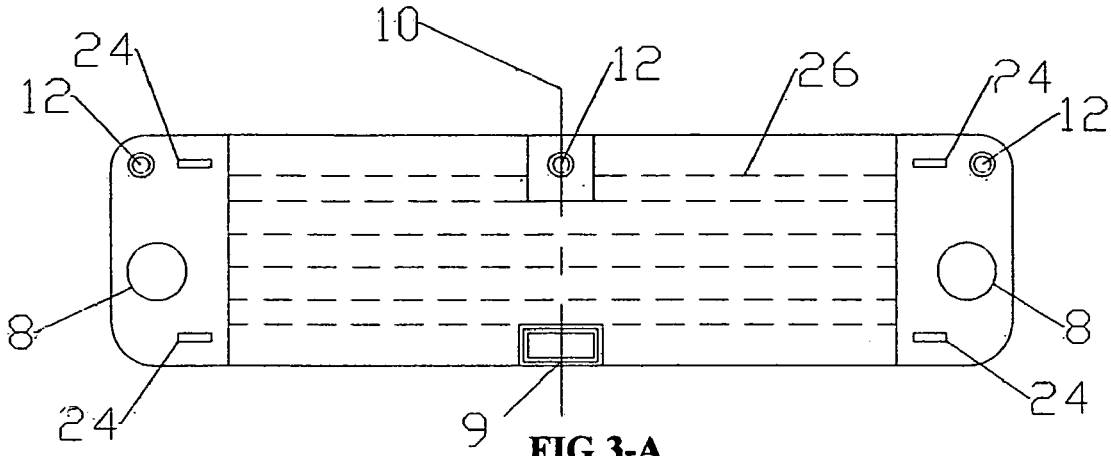
FIG 3-A
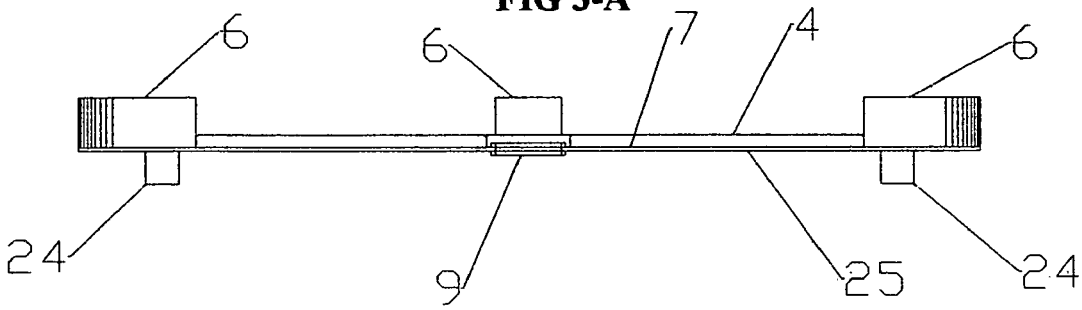
FIG. 3-B
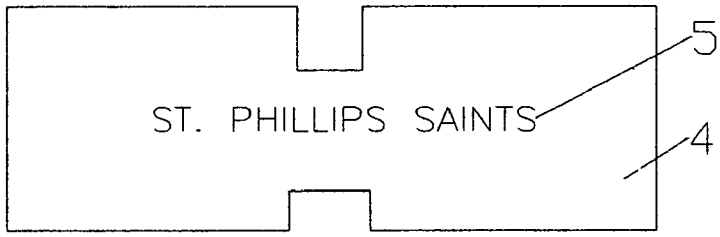
FIG. 4

PORTABLE COLLAPSIBLE OPEN AIR HANDS FREE SEATING SHELTER

CROSS-REFERENCE TO RELATED APPLICATION

This application is entitled to the benefit of Provisional Patent Application No. 60/563,230 titled Bleacher Buddy—Outdoor Sports Fan Gear filed on Apr. 19, 2004.

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

1. Field of Invention

The present invention relates to a portable collapsible open air hands free seating shelter to be used in bleachers located at parks and stadium venues. The invention provides protection against elements such as rain, sun and heat exposure. The invention is lightweight, has a limited amount of parts, able to be set up in seconds and able to seat one or more people comfortablely. Finally, the invention will display the users preferred team's colors announcing to other spectators the team the user is supporting.

2. Description of Prior Art

During outdoor events spectators can and do receive near to dangerous amounts of sun and heat exposure causing a drop in attendance. To prevent any amount of sun and heat exposure many people use many different types of umbrella type apparatus, with most of them requiring at lest the use of one hand if not both causing fatigue and strain on the arms. Other apparatus allowing for hands free operation are bulky, comprise of a large amount of parts and are unmanageable. Yet other hands free operation apparatus are difficult to set up and require a large amount of time and patients to do so. None of the prior art affirmatively or impliedly asserts a color or lettering scheme supporting a preferred or selected sports team, as does the preferred invention.

U.S. Pat. No. 3,052,251 De Jean, "Spectator Shelter," issued Sep. 4, 1962, U.S. Pat. No. 3,893,466 Barker, "Portable Collapsible Shelter," issued Jul. 8, 1975 and U.S. Pat. No. 5,287,872 Anderson, "Portable Umbrella Shelter," issued Feb. 22, 1994 are similar to the current invention but are not considered to be open air and are mechanically complex when compared to the preferred embodiment of the current invention.

U.S. Pat. No. 6,478,037 Tung, "Foldable Sunshade with a Tiltable Canopy," issued Nov. 12, 2002 is capable of shading spectators from the elements but is less suitable to bleachers and stadiums and is much more mechanically complex when compared to the preferred embodiment of the current invention.

When all of the prior art is compared to the current preferred embodiment of the invention the prior art is mechanically more complex, not suitable to stadiums and bleachers and/or not considered to be open air allowing for proper ventilation reducing the effects of sun and heat exposure.

SUMMARY OF THE INVENTION

It is a primary object of the present invention to provide a portable collapsible open air hands free seating shelter to provide protection against elements such as, but not limited to, rain, sun and heat exposure.

It is another object of the present invention that it be lightweight, easily transportable, comprise of a small amount of assembly parts and able to be set up in seconds.

It is a further object of the present invention that it be used for bleachers located at parks and stadium venues being designed to attach to most bleachers capable of seating one or more people comfortably and displaying the users preferred team colors and lettering.

A portable collapsible open air hands free seating shelter in accordance with the present invention comprises:

a base;

a plurality of cover mounts detachablely coupled to the base; and a cover slidably attached to the plurality of cover mounts.

A plurality of raised top portions of the base comprises at least one cylindrical void perpendicular to the plurality of raised top portions. The base comprises a plurality of seat clamps detachablely coupled to a bottom portion of the base. In addition, the plurality of seat clamps may be integrated with the bottom portion of the base.

The plurality of cover mounts having a continually intergraded vertical first end detachablely coupled to the base and a horizontal second end which is substantially perpendicular to the vertical first end. In alternative, the plurality of cover mounts having a vertical end and a horizontal end wherein the vertical end is either pivotally or detachably coupled to the horizontal end.

The cover having a continually integrated canopy portion having a closed end, a head panel and a back support panel having an open end slidably attached to the plurality of cover mounts. The canopy portion having a closed end further comprising a face portion equal to a length to the cover and having a width. In alternative, the cover comprising a plurality of cover mount slide tubes slidably attached to the plurality of cover mounts. Also, where the back support panel is integrated into the plurality of cover mounts. Further, where the cover only consists of a canopy portion. Ultimately, where the cover and plurality of cover mounts are integrated into a single cover assembly.

The base has a seat integrated into or detachablely coupled to the base. The base having a center, a plurality of outer sides and a substantially rectangular handle void located near the center and near one of the outer sides.

Finally, A portable collapsible open air hands free seating shelter in accordance with the present invention comprises:

a base;

a cover mount detachablely coupled to the base; and a cover slidably attached to the cover mount.

Other objects, advantages and novel features of the invention will become apparent from the following detailed description when taken in conjunction with the accompanying drawings.

BRIEF DESCRIPTION OF THE DRAWINGS

FIG. 2-A is an assembled front view of the shelter;

FIG. 2-B is an assembled side view of the shelter;

FIG. 3-A is a plan view of the base;

FIG. 3-B is a front view of the base;

FIG. 4 is a plan view of the seat portion;

DETAILED DESCRIPTION OF THE PREFERRED EMBODIMENT

Figure 1:
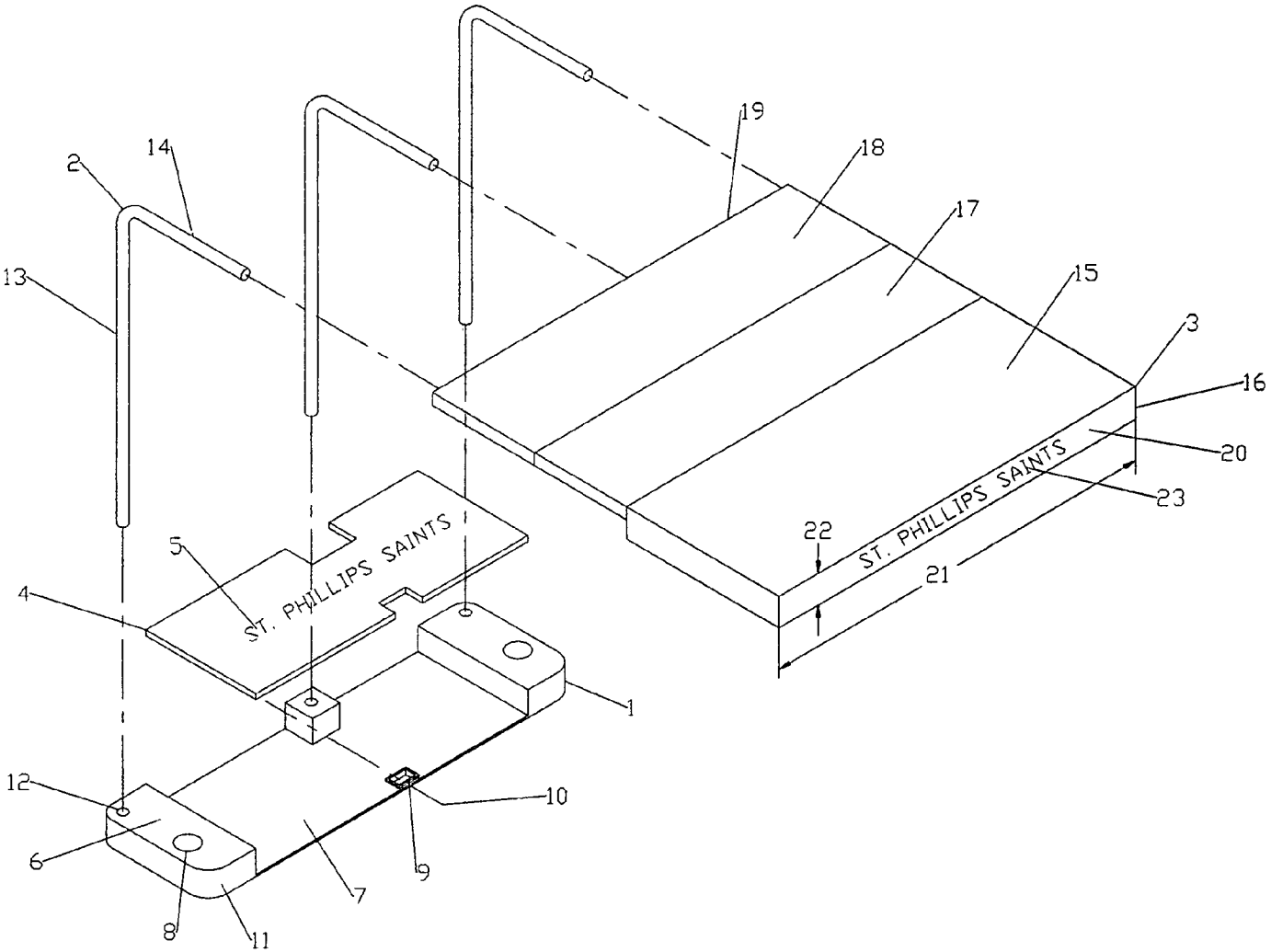
FIG. 1 is an exploded perspective view of the portable collapsible open air hands free seating shelter in accordance with the present invention.

For the purposes of promoting and understanding of the principle of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Referring to the drawings and initially to FIG. 1, a portable collapsible open air hands free seating shelter in accordance with the present invention generally includes a base 1, a plurality of cover mounts 2 detachablely coupled to the base 1 and a cover 3 slidably attached to the plurality of cover mounts 2. In the preferred embodiment the plurality of cover mounts 2 include three cover mounts 2 which increase the rigidity of the assembly and the middle cover mount 2 acts like a divider between two users while they take in a sporting event. The base 1 includes a seat portion 4 detachablely coupled to the base 1. The seat portion 4 can be labeled with the desired professional sport's team or preferred name as shown with seat lettering 5. In the preferred embodiment the seat portion 4 and the seat lettering 5 will also include the professional sport's team's colors. The base 1 further includes a plurality of raised top portions 6 and a lower top portion 7 each being substantially parallel to the other. In the preferred embodiment, the plurality of raised top portions 6 houses at least one cylindrical void 8 that is substantially perpendicular to the plurality of raised top portions 6. The cylindrical voids 8 are envisioned to be used for securely holding various refreshments and other objects. The seat portion 4 in the preferred embodiment detachablely couples to the lower top portion 7 of the base 1.

In addition, the base 1 houses a substantially rectangular handle void 9 located near a center 10 and a plurality of outer sides 11 of the base 1. The substantially rectangular void 9 in the preferred embodiment is intended to be used as a handle in order to increase the ease of transportation of the shelter from venue to venue. The plurality of raised top portions 6 house a plurality of base couplers 12. The plurality of cover mounts 2 further include a continually integrated vertical first end 13 detachablely coupled to the plurality of base couplers 12 in the base and a horizontal second 14 end such that the vertical first end 13 and the horizontal second end 14 are substantially perpendicular to each other. The detachable coupling between the vertical first end 13 of the plurality of cover mounts 2 and the plurality of base couplers 12 in the base 1 are quick release couplers to decrease the time and difficulty of assembly.

The cover 3 includes a continually integrated canopy portion 15 having a closed end 16, a head panel 17 and a back support panel 18 having an open end 19. The open end 19 of the cover 3 being slidably attached to the horizontal second end 15 of the plurality of cover mounts 2. The slidable interface between the cover 3 and the plurality of cover mounts 2 will further increase the ease of assembly by allowing the cover 3 to slip fit over the plurality of cover mounts 2. The canopy portion 15 having a closed end 16 having a face portion 20 equal to a length 21 of the cover and having a width 22. The face portion 20 in the preferred embodiment will house face lettering 23 that will match the seat lettering 5.

Referring to FIG. 2-A and FIG. 2-B, these figures represent the preferred embodiment fully assembled. The base 1 includes a plurality of seat clamps 24 detachablely coupled to the base 1. The plurality of seat clamps 24 are specifically detachablely coupled to a bottom portion 25 of the base 1 in the preferred embodiment. The plurality of seat clamps 24 are used to ensure that the shelter is secure and safe during use. In the preferred embodiment the plurality of seat clamps 24 are designed for quick and easy assembly with the base 1 to further ensure the ease of and reduce the time of assembly. As shown in the figures and in the preferred embodiment, the canopy portion 15 will supply most of the protection from the elements such as, but not limited to, rain, sun and heat. When the cover 3 is slidably attached to the plurality of cover mounts 2 the back support panel 18 will support the back of the user while being protected from the elements by the canopy portion 15 and the head panel 17 while viewing a sporting event. The closed end 16 of the cover 3 will act as a stopping point for the horizontal second end 14 of the plurality of cover mounts 2. The closed end 16 will also hide the plurality of cover mounts 2 adding to the esthetic beauty of the shelter. It is further envisioned that the canopy portion 15 and the back support panel 18 will be manufactured with colored material preferably with the color of the sports team matching the seat portion 4. The head panel 17 is envisioned to be made from a clear or see through material increasing the range of site for the user.

Referring to FIG. 3-A and FIG. 3-B, these figures show in further detail the base 1. These figures give a better understanding of the location of the plurality of raised portions 6, the lower portion 7, the cylindrical void 8, the rectangular handle void 9, the center 10, the plurality of outer sides 11, the plurality of base couplers 12, the plurality of seat clamps 24 and the bottom portion 25 in the preferred embodiment. The base 1 further includes a plurality of seat coupling strips 26. In the preferred embodiment the plurality of seat coupling strips 26 are made out of Velcro® or an equivalent coupling material. The plurality of seat coupling strips 26 will further increase the ease of assembly and decrease the time needed for assembly.

Referring to FIG. 4, this figure shows in further detail the seat portion 4 with seat lettering 5. In the preferred embodiment the seat portion 4 will have a slip fit with the lower top portion 7 of the base 1.

In an alternative embodiment of the portable collapsible open air hands free seating shelter the plurality of seat clamps 24 are integrated into the base 1, which will reduce the number of assembly pieces and further increase the ease of assembly. Also, in an alternative embodiment of the preferred invention, the plurality of cover mounts 2 having a vertical first end 13 detachablely coupled to the base 1 and a horizontal second end 14 wherein the vertical first end 13 is either pivotally or detachablely coupled to the horizontal second end 14. This arrangement will increase the portability of the entire invention by decreasing the size and rigidity of the plurality of cover mounts 2.

Figure 5:
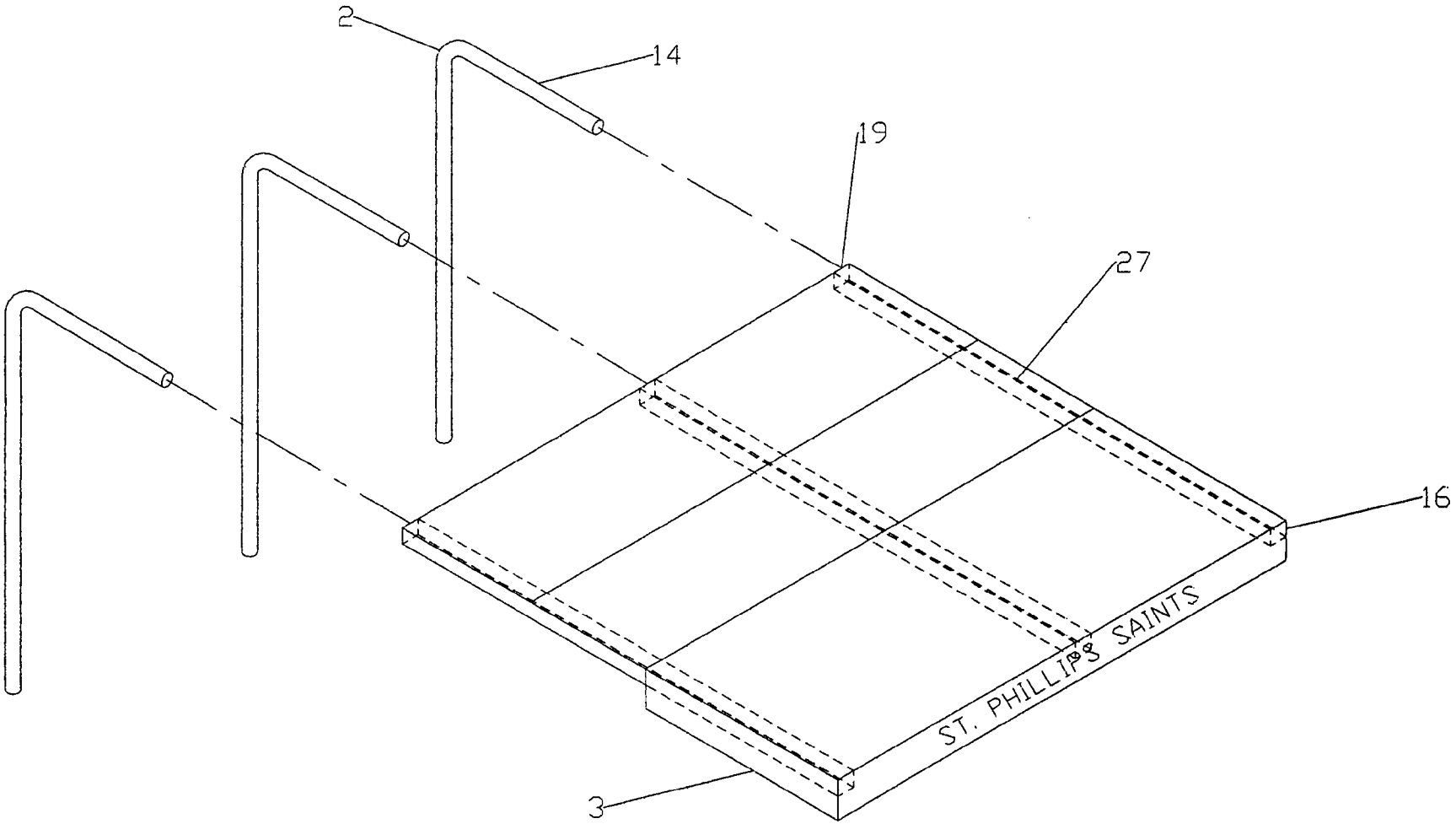
FIG. 5 is an exploded perspective of an alternative embodiment of the shelter.

Referring to FIG. 5, the cover 3 includes a plurality of cover mount slide tubes 27, which will increase the stiffness of the cover 3 and the plurality of cover mounts 2 assembly by decreasing the mobility of the plurality of cover mounts 2.

Figure 6:
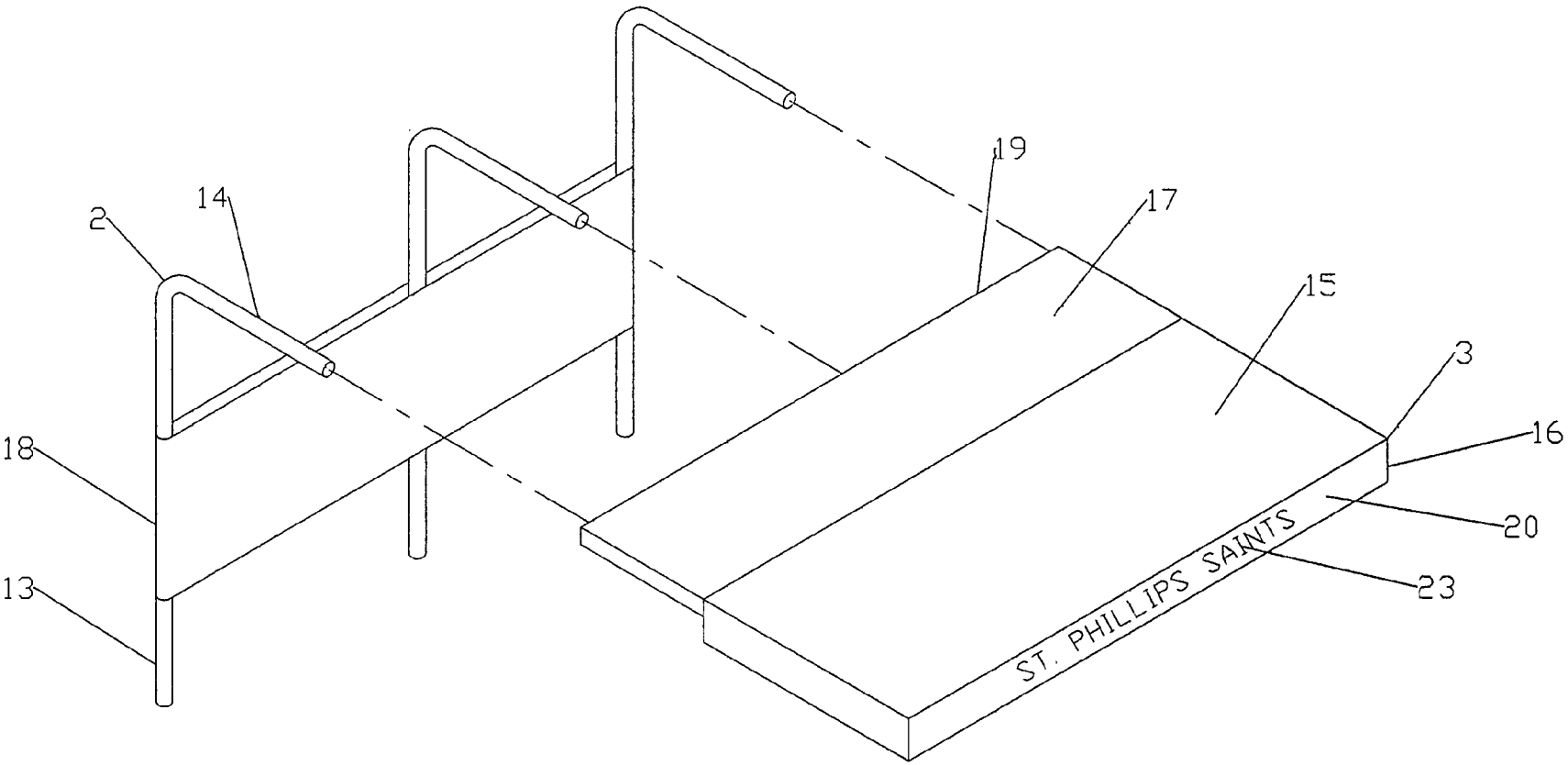
FIG. 6 is an exploded perspective of an alternative embodiment of the shelter.
Figure 7:
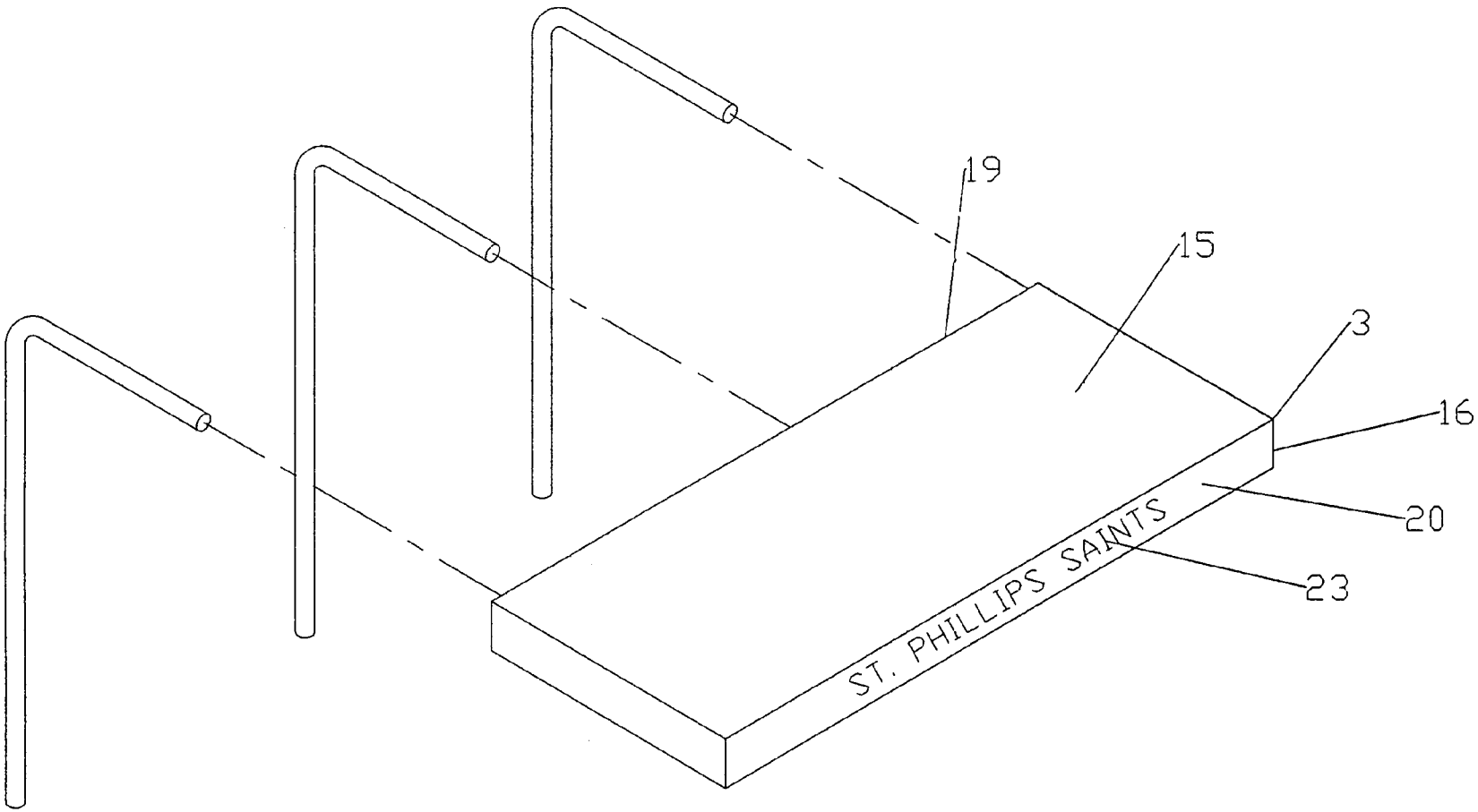
FIG. 7 is an exploded perspective of an alternative embodiment of the shelter.
Figure 8:
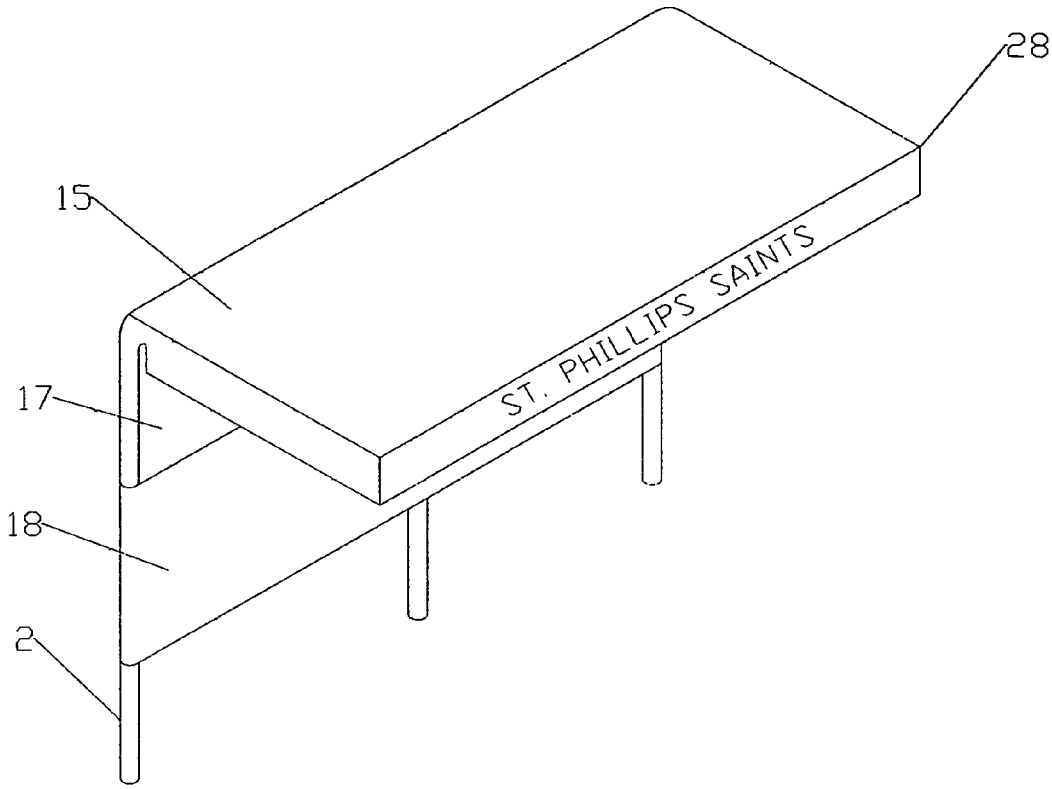
FIG. 8 is an exploded perspective of an alternative embodiment of the shelter.

Referring now to FIG. 6, in another alternative to the preferred embodiment, the cover 3 includes a canopy portion 15, having a closed end 16, and a head panel 17 with an open end 19 that is slidably attached to the plurality of cover mounts 2 which have a back support panel 18 integrated into the plurality of cover mounts 2. This embodiment will decrease the size of the cover 3 which will increase the ease of transportation and assembly. Also, this alternative embodiment will increase the rigidity of the plurality of cover mounts 2 and make them easier to transport by holding them all together. Looking at FIG. 7, to further increase the ease of assembly and transportation another alternative embodiment includes a cover 3 only consisting of a canopy portion 15 with an open end 19 slidably attached to the plurality of cover mounts 2. Yet still and referring to FIG. 8, the plurality of cover mounts 2 and the cover 3 are integrated into a cover assembly 28 further decreasing the number of parts to be assembled and increasing the ease of transportation of the entire invention. Also, to further decrease the number of parts, the seat portion 4 may be integrated into the base 1. Finally, the plurality of cover mounts 2 are shown with three but the invention may easily incorporate only two or even just a single cover mount 2.

While the invention has been illustrated and described in detail in the drawings and foregoing descriptions, the same is to be considered as illustrative and not restrictive in character. It should be understood that only the preferred embodiments have been shown and described and that all changes and modifications that come within the spirit of the invention are desired to be protected.

What is claimed is:

1. A shelter comprising:

a base;

a plurality of cover mounts detachably coupled to said base;

a cover slidably attached to said plurality of cover mounts;

wherein said base having a plurality of raised top portions, a lower top portion substantially parallel to said plurality of raised top portions, a bottom portion and a plurality of outer side portions;

said plurality of cover mounts having a' continually integrated vertical first end detachably coupled to at least one of said plurality of raised top portions of said base and a horizontal second end such that said vertical first end and said horizontal second end are substantial perpendicular to each other;

said cover having a continually integrated canopy portion having a closed end, a head panel and a back support panel having an open end slidably attached to said horizontal second end of said plurality of cover mounts;

a seat portion detachably, coupled to said lower top portion of said base; and a plurality of seat clamps detachably coupled to said bottom portion of said base.

2. A shelter comprising:

a base;

a plurality of cover mounts detachably coupled to said base; and a cover slidably attached to said plurality of cover mounts, wherein said base having a plurality of raised top portions having at least one cylindrical void perpendicular to and within at least one said plurality of raised top portions.

3. The shelter as claimed in claim 1, further comprising a plurality of seat clamps detachably coupled to said base.

4. The shelter as claimed in claim 1, further comprising a plurality of seat clamps integrated into said base.

5. The shelter as claimed in claim 1, wherein said plurality of cover mounts having a continually intergraded vertical first end detachably coupled to said base and a horizontal second end such that said vertical first end and said horizontal second end are substantial perpendicular to each other.

6. The shelter as claimed in claim 1, wherein said plurality of cover mounts having a vertical first end detachably coupled to said base and a horizontal second end wherein said vertical first end is pivotally attached to said horizontal second end.

7. The shelter as claimed in claim 1, wherein said plurality of cover mounts having a vertical end detachably coupled to said base and a horizontal end wherein said vertical end is detachably coupled to said horizontal end.

8. A shelter comprising:

a base a plurality of cover mounts detachably coupled to said base; and a cover slidably attached to said plurality of cover mounts, wherein said cover having a continually integrated canopy portion having a closed end, a head panel and a back support panel having an open end slidably attached to said plurality of cover mounts.

9. The shelter as claimed ha claim 1, wherein said cover having a canopy portion having a closed end further comprising a face portion equal to a length of said cover, having a width and housing face lettering.

10. The shelter as claimed in claim 1, wherein said cover comprises a plurality of cover mount slide tubes slidably attached to said plurality of cover mounts.

11. A shelter comprising:

a base;

a plurality of cover mounts detachably coupled to said base; and a cover slidably attached to said plurality of cover mounts, wherein said cover having a continually integrated canopy portion, having a closed end, and a head panel such that said head panel comprises of au open end slidably attached to said cover mounts having a back support panel integrated with said plurality of cover mounts.

12. The shelter as claimed in claim 1, wherein said cover having a canopy portion having an open end slidably attached to said cover mounts.

13. The shelter as claimed in claim 1, wherein said plurality of cover mounts and said cover are integrated into a cover assembly.

14. The shelter as claimed in claim 1, further comprising a seat portion integrated into said base.

15. The shelter as claimed in claim 1, further comprising a seat portion detachably coupled to said base.

16. A shelter comprising;

a base;

a plurality of cover mounts detachably coupled to said base; and a cover slidably attached to said plurality of cover mounts, wherein said base having a center, a plurality of outer sides and a substantially rectangular handle void located near said center and substantially near at least one said plurality of outer sides.

17. A shelter comprising:

a base having a plurality of raised top portions, a lower top portion substantially parallel to said plurality of raised top portions, a bottom portion and a plurality of outer side portions;

a plurality of cover mounts having a continually integrated vertical first end detachably coupled to at least one of said plurality of raised top portions of said base and a horizontal second end such that said vertical first end mad said horizontal second end are substantial perpendicular to each other;

a cover having a continually integrated canopy portion having a closed end, a head panel and a back support panel having an open end slidably attached to said horizontal second end of said plurality of cover mounts;

a seat portion detachably coupled to said lower top portion of said base; and a plurality of seat clamps detachably coupled to said bottom portion of said base.

* * * * *